US005355796A

United States Patent [19]

Köbler et al.

[11] Patent Number: 5,355,796

[45] Date of Patent: Oct. 18, 1994

[54] ANILOX OFFSET PRINTING UNIT WITH A SHORT INKING DEVICE

[75] Inventors: Ingo Köbler, Anhausen; Hans Mamberer, Königsbrunn, both of Fed. Rep. of Germany

[73] Assignee: MAN Roland Druckmaschinen AG, Offenbach, Fed. Rep. of Germany

[21] Appl. No.: 40,126

[22] Filed: Mar. 30, 1993

[30] Foreign Application Priority Data

Apr. 4, 1992 [DE] Fed. Rep. of Germany .... 4211379.2

[51] Int. Cl.[5] ..... B41F 7/26; B41F 31/06

[52] U.S. Cl. ..... 101/148; 101/350

[58] Field of Search ..... 101/350, 363, 351, 352, 101/207-210, 148, 487, DIG. 45

[56] References Cited

U.S. PATENT DOCUMENTS 2,568,761 9/1951 Peyrebrune ..... 101/226

FOREIGN PATENT DOCUMENTS

0069976A1 1/1983 European Pat. Off. .
3707996C1 10/1988 Fed. Rep. of Germany .
1140380 7/1957 France .
92/04188 3/1992 World Int. Prop. O. .

OTHER PUBLICATIONS

EPO Search Report dated Aug. 25, 1993 (4 pp. including abstract ) EP 9310 5094.

*Primary Examiner*—J. Reed Fisher
*Attorney, Agent, or Firm*—Cohen, Pontani, Lieberman & Pavane

[57] ABSTRACT

An anilox offset printing unit includes a short inking device mounted between side walls with a screen roller which can be doctored and immersed in an ink reservoir, an inking roller, and a plate cylinder for inking a rubber blanket cylinder, and a damping device acting on the plate cylinder. An adjusting device having two degrees of freedom serves to adjust the distance between the axes of the inking roller and the screen roller and/or the distance between the axes of the inking roller and the plate cylinder, wherein the adjustment is carried out by the adjusting device in accordance with a measurement value determined by a measuring element which interacts with the adjusting device.

11 Claims, 3 Drawing Sheets

ANILOX OFFSET PRINTING UNIT WITH A SHORT INKING DEVICE

BACKGROUND OF THE INVENTION

1. Field of the Invention

The present invention relates to an anilox offset printing unit with a short inking device. The inking device is mounted between side walls and includes a screen roller which can be doctored and can be immersed in an ink container, an inking roller, and a plate cylinder for inking a rubber blanket cylinder, wherein the plate cylinder interacts with a damping device.

2. Description of the Related Art

Anilox offset short inking devices of the above-described type do not have zone screws, but a fixedly mounted screen roller which can be doctored, so that the quantity of ink to be transferred can no longer be influenced directly. The quantity of ink to be transferred depends primarily on the type of the screen of the screen roller, and on the physical properties of the ink which is being used.

Tests have shown that the transfer width from the inking roller to the screen roller also influences the ink transfer, so that metering of the quantity of ink can be influenced by the width of the contact zones between the rollers. In addition, the transfer width from the inking roller to the plate cylinder influences the emulsifying behavior of the ink. The compulsive forces between the rollers, the quantity of damping agent emulsified into the ink, and the amount of damping agent required for being able to print without tint, all increase as the transfer width increases.

With increasing operating time of the machine, the temperature increase caused, inter alia, by the squeezing or pressing work of the rollers of the inking device, leads to a thermal expansion of the machine. The transfer widths of the inking roller to the plate cylinder and to the screen roller change as a result and deviate from the adjusted desired values.

The temperature increase of the machine additionally causes an increase of the temperature of the ink, so that the physical properties of the ink change. Among other changes, the tendency to emulsify increases, so that it is necessary to keep small the mechanical values which influence the formation of emulsions, i.e., primarily the squeezing or pressing forces in the gap between the inking roller and the plate cylinder.

British patent no. 620,148, which generally relates to an inking device of a printing machine, deals with the problem of the influence on the ink properties caused by a temperature increase. To take this value into consideration, British patent 620,148 proposes to change the gap between an ink well roller and the ink accepting roller. The change of the distance between the rollers is effected by means of an eccentric support of the ink accepting roller. Since the results of such a subsequent control can be checked only during the production sequence, variations of the ink on the print carrier are almost inevitable. In addition, the supply of damping agent is not taken into consideration when the ink properties are changed because an ink density regulation by changing the transfer width independently of the temperature is not being considered. Thus, the possibility of adjustment proposed in British patent 620,148 does not provide a solution for changing the transfer width of the inking roller to the screen roller and/or the inking roller to the plate cylinder.

SUMMARY OF THE INVENTION

Therefore, it is the primary object of the present invention to provide a short inking device in an anilox offset printing unit which makes it possible to influence the quantity of ink over the width of the cylinder, which keeps the desired ink density constant over the entire contact area and which inhibits the formation of emulsions.

In accordance with the present invention, the inking device includes an adjusting device for changing the transfer widths from the inking roller to the screen roller and/or from the inking roller to the plate cylinder, the adjusting device operating with at least two degrees of freedom in dependence on a measured value determined by means of at least one measuring element which interacts with the adjusting device.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

The present invention is further described in detail below with reference to the accompanying drawing, in which.

DESCRIPTION OF THE PRESENTLY PREFERRED EMBODIMENT

Figure 1:
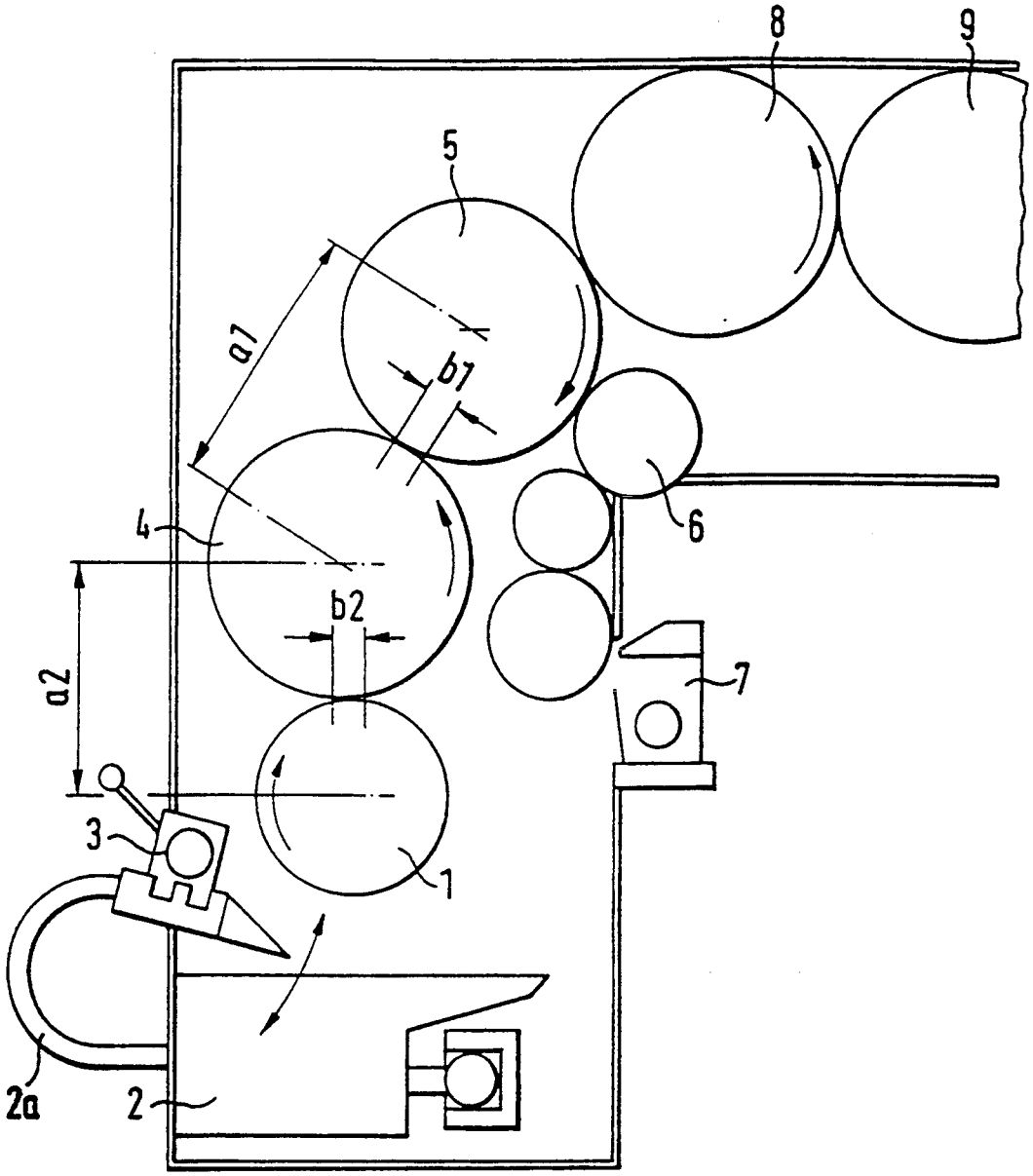
FIG. 1 is a schematic view of an anilox offset printing unit.

The printing unit schematically illustrated in FIG. 1 includes a short inking device with a screen roller 1 which is adjustable relative to an ink well 2 with a wiping or doctor unit 3, and an inking roller 4. The ink removed from the ink well 2 by means of the screen roller 1 is initially transferred to the inking roller 4 and from the inking roller 4 to a plate cylinder 5, wherein the screen roller 1 is being doctored off by means of the doctoring unit 3.

A damping roller 6 of a damping device 7 is in contact with the plate cylinder 5. The plate cylinder 5 transfers the ink to a rubber blanket cylinder 8 which is in contact with another cylinder 9. The cylinder 9 either is a counterpressure cylinder or the rubber blanket cylinder of another inking device. The quantity of ink transferred during the ink transfer from a roller 1 to the other roller 4 or to the plate cylinder 5 depends essentially on the transfer width b2 of the contacting rollers 1 and 4.

The transfer width b1 between roller 4 and plate cylinder 5, on the other hand, is influenced by the quantity of damping agent which is emulsified into the ink and is separated back into the inking device.

Figure 2:
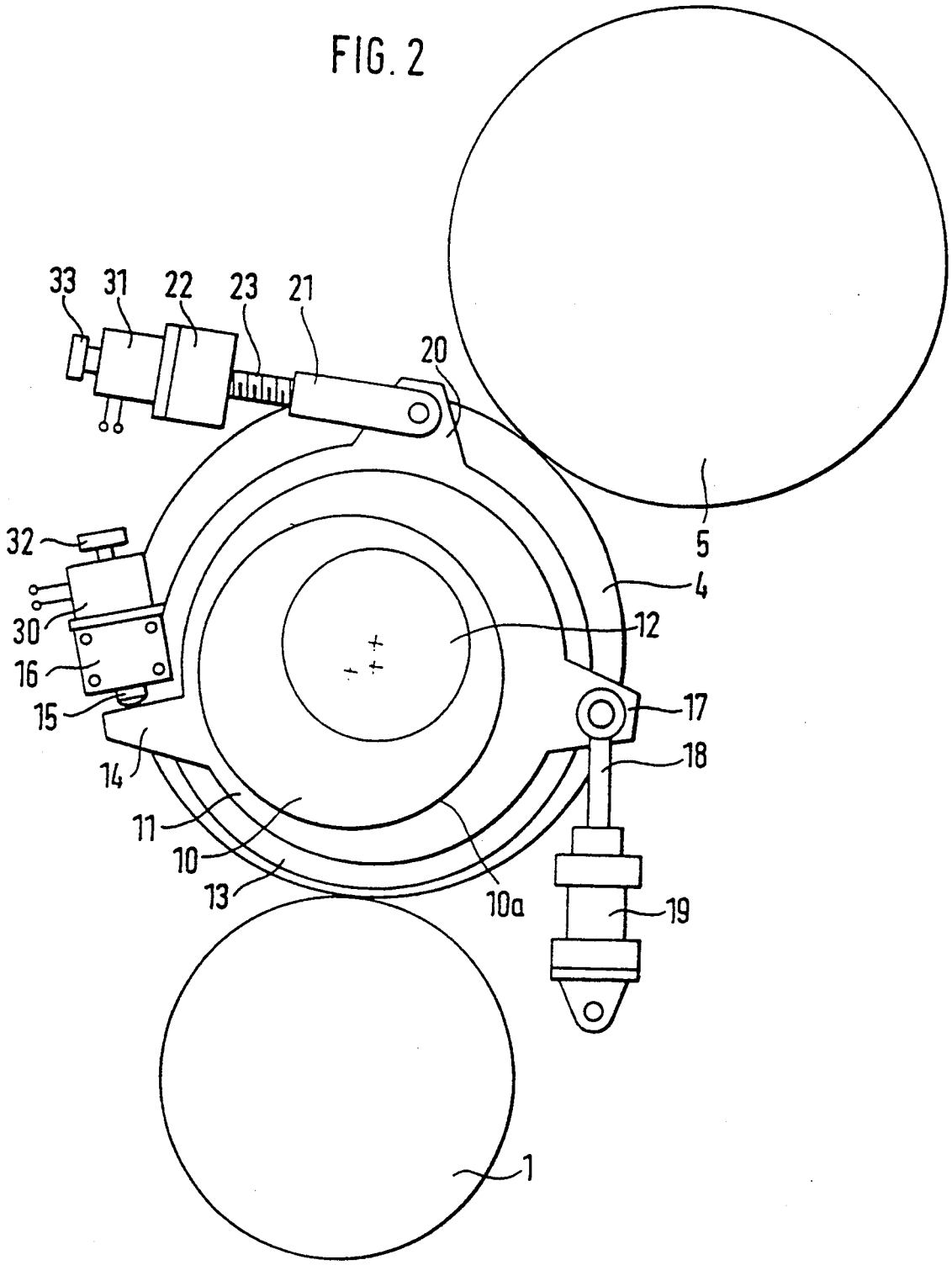
FIG. 2 is a schematic view, on a larger scale, of a detail of the printing unit of FIG. 1 showing an adjusting device for changing the spacings between the axes of the inking roller to the plate cylinder and/or the inking roller to the screen roller.

FIG. 2 of the drawing shows an embodiment of the adjusting device for changing the distance between the axes of the inking roller 4 and the green roller 1, and between the axes of the inking roller 4 and the plate cylinder 5. The inking roller 4 is rotatably mounted on both sides about an axis 12 in the side walls by means of an inner eccentric bushing 10 and an outer eccentric bushing 13. The inner eccentric bushing 10 is rotatably mounted on the surface 10*a* of the outer eccentric bushing 13. The inner eccentric bushing 10 has a lateral clamping ring 11. The clamping ring 11 has a projection 14 which interacts with a stop member 16 which is fixedly mounted on the side wall and is adjustable by means of a motor-driven threaded part 15. The clamping ring 11 further includes a second projection 17 which is connected in an articulated manner to a piston 18 of an adjusting cylinder 19 which is rotatably mounted on the side wall. The cylinder 19 may be, for example, a pneumatic cylinder.

Depending on the direction of actuation of the cylinder 19, a turning of the inner eccentric bushing 10 results either in pressing of the inking cylinder 4 against the screen roller 1 and the plate cylinder 5, or in a removal of the inking roller 4 from the screen roller 1 and from the plate cylinder 5, because the inner eccentric bushing 10 makes possible a relatively large eccentric turning.

Figure 3:
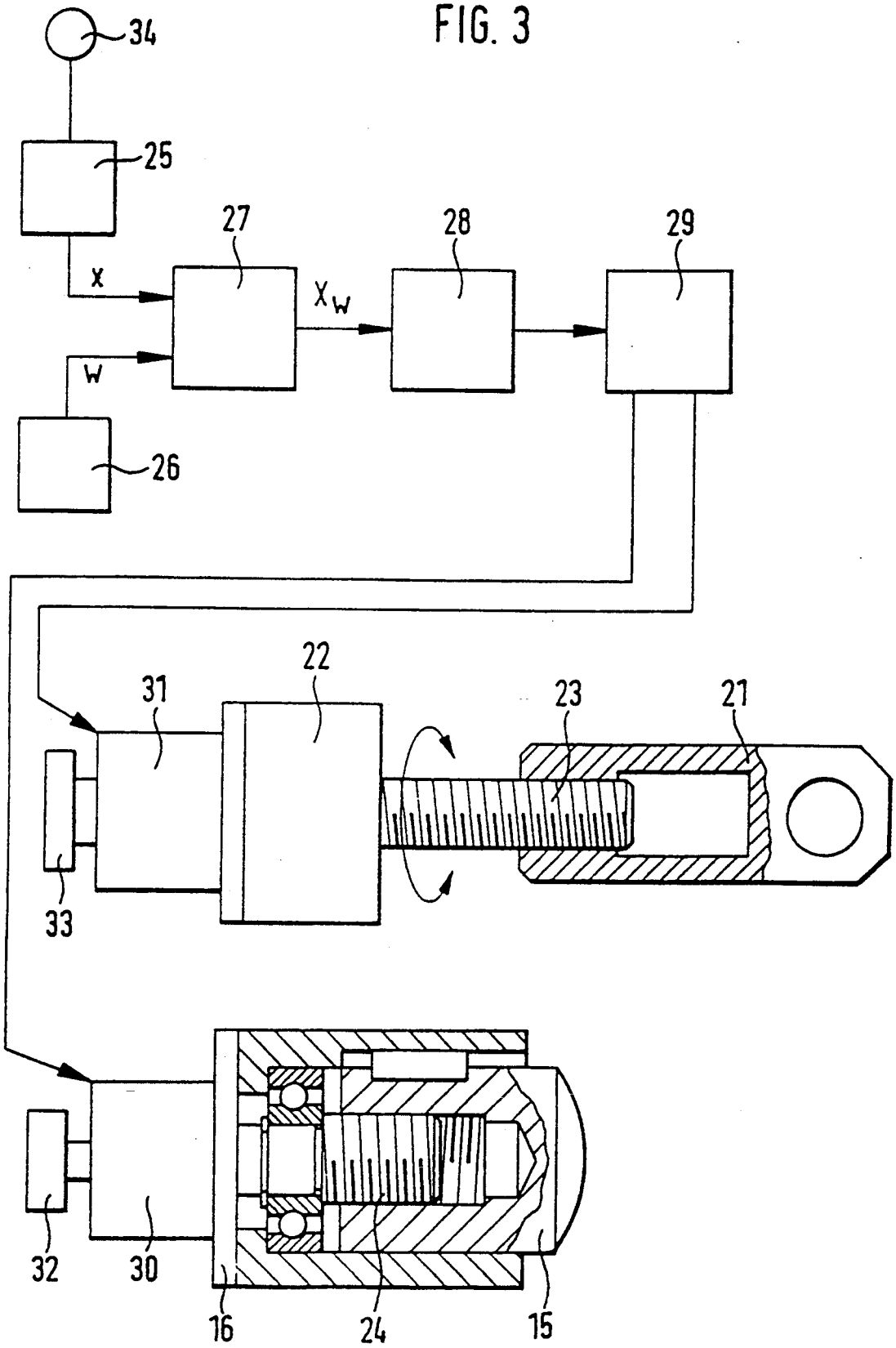
FIG. 3 is a diagram of the switching arrangement for the adjusting device.

The outer eccentric bushing 13 is connected with a projection 20 in an articulated manner to a pull rod 21 of an adjusting device 22. As illustrated in FIG. 3, the pull rod 21 can advantageously be moved back and forth in the known manner by means of a motor and a threaded part 23 and a worm wheel. The stop member 16 for the inner eccentric bushing 10 and the adjusting device 22 for the outer eccentric bushing 13 facilitate a finely adjusted change of the transfer widths b1, b2 of the inking roller 4 to the screen roller 1 and/or the plate cylinder 5.

The gear element or threaded part 15 of the stop member 16 is constructed as a bolt which interacts in the known manner with an adjusting spindle 24, as shown in FIG. 3, so that the adjustable stop member 16 can turn the inner eccentric bushing 10 to a limited extent. On the one hand, the adjusting cylinder 19 presses the inner eccentric bushing 10 against the stop member 16 and, on the other hand, the stop member 16 can turn the inner eccentric bushing 10 against the adjusting cylinder 19 because the stop member 16 can apply, by means of the adjustable gear element 15, a greater force than the adjusting cylinder 19. Accordingly, a secure seat of the inking roller 4 in its supports is always ensured.

As illustrated in FIG. 3 of the drawing, the adjusting device 22 and the stop 16 are connected to a switching arrangement. The switching arrangement includes generally a signal modulator 25 and a setting means 26 which are both connected to a comparator element 27. The switching arrangement is connected to a stepping motor 30 of the stop member 16 of the inner eccentric bushing 10 and to a stepping motor 31 of the adjusting element 22 of the outer eccentric bushing 13 through a transmission element 28 with an adjustable time behavior, so that the time behavior of the regulating device can be adapted to the time behavior of the controlled system, and through a signal amplifier 29. The stepping motors 30, 31 are each provided with a preadjusting wheel 32, 33, respectively. The signal modulator 25 is coupled to a measuring element 34.

Accordingly, the present invention meets the above-stated object by controlling the transfer widths b1, b2. After setting a basic adjustment, which may be changed by the printer even during printing, the automatic readjustment of the transfer widths takes place based on this basic adjustment, such that the printing results are being kept constant. The measurement values which can be used for this control are the ink density, on the one hand, but also, on the other hand, those parameters which measure, cause or correlate with the changes in the transfer widths. These parameters are the linear forces and beating forces which are difficult to measure on-line and are interrelated with the transfer widths, and especially the temperatures in the roller or cylinder bodies and side walls which cause the changes.

Thus, the measuring element 34 may be a densimeter which measures the ink density either on-line or off-line, or a resistance strain gauge which measures the bearing force of the adjusted inking roller 4, or scanning wheels which scan on-line the cylinder diameter of the inking roller 4. However, the preferred embodiment of the measuring dement 34, since it is the least expensive, is a thermo-sensitive element.

In the exemplary embodiment of the invention, the temperature is measured at several locations. Thus, the temperatures of the rollers or cylinders are measured, as well as the temperatures of the side walls.

Suitable for measuring the roller or cylinder temperatures are thermo-couple elements which are either integrated in the rollers or cylinders 1, 4, 5, or are mounted in finger protector spindles, not shown in the drawing, which are arranged near the roller or cylinder surfaces in the gaps between the screen roller 1 and inking roller 4, and between the inking roller 4 and the plate cylinder 5. If a cooling system is provided, the thermo-couple elements may also be arranged in the cooling system, wherein the temperatures of the coolant being supplied and of the coolant being discharged are measured. Depending on the type of cooling cycle, the quantity of coolant flowing through the system can also be incorporated in the control as a measurement parameter. The temperatures of the side walls can be determined by means of thermo-couple elements installed on the side walls or within the side walls.

If a temperature change is determined by means of the thermo-sensitive elements, the corresponding voltage changes in the thermo-couple elements 34 supply electric signals through the signal modulator 25 to the comparator dement 27. In the comparator dement 27, the appropriately modulated measurement value X is compared to the desired ink density value w provided by the setting means 26 and the difference $X_w$ is transmitted through the transmission element 28 and the signal amplifier 29 in the form of a voltage value to the two stepping motors 30, 31.

A signal modulator 25 can be omitted if the measuring element used is a densimeter which measures the ink density directly.

Accordingly, on the one hand, it is possible to control the quantity of ink by changing the transfer width b2 of the inking roller 4 relative to the screen roller 1 by changing the distance a2 between the axes of the rollers and, on the other hand, it is possible to control the quantity of moisture emulsified into the ink by changing the transfer width b1 of the inking roller 4 relative to the plate cylinder 5 by changing the distance a1 between the axes of the inking roller 4 and the plate cylinder 5. For example, when a desired ink density is achieved with a preadjustment of the transfer widths b1, b2 by means of the adjusting cylinder 19 and the preadjusting wheels 32, 33 at 20° C. surface temperature of the inking roller 4, the transfer widths b1, b2 must be reduced when the temperature increases by changing the distances a1, a2 between the axes. The setting means 26 may deliver a constant value w, which can be changed by desired values during the course of the printing process, or the desired value w follows a temperature-dependent start-up curve determined by measurements. The two eccentric bushings 10, 13 are moved in accordance with a non-linear function. Accordingly, two adjustments are always carried out which are not in a linear relationship. The double-eccentric support has two degrees of freedom.

It would be conceivable to provide two linear adjusting devices for uncoupling the adjustment movements. However, this arrangement would be very complicated, so that this embodiment is not carried out.

The double-eccentric support 10, 13 with its adjusting devices 16, 19, 22 is identical on both sides of the inking roller 4. By carrying out different adjustments, it is possible to obtain a very small axial inclined position of the inking roller 4 relative to the screen roller 1 and the plate cylinder 5, in order to compensate for any ink density differences over the width of the inking roller 4.

It should be understood that the preferred embodiment and examples described are for illustrative purposes only and are not to be construed as limiting the scope of the present invention which is properly delineated only in the appended claims.

We claim:

1. An anilox offset printing unit with a short inking device mounted between side walls, the printing unit comprising a screen roller, means for doctoring the screen roller, and means for applying ink to the screen roller, an inking roller in contact with the screen roller over a first transfer width, and a plate cylinder for inking a rubber blanket cylinder, the inking roller being in contact with the plate cylinder over a second transfer width, a damping device for damping the plate cylinder, adjusting means with at least two degrees of freedom for adjusting at least one of the transfer widths between the inking roller and the screen roller and between the inking roller and the plate cylinder, and at least one measuring means for measuring selected parameters of the printing unit, and means connected to the measuring means for controlling the adjusting means.

2. The anilox offset printing unit according to claim 1, wherein the inking roller has ends, and wherein the adjusting means comprises, on the ends of the inking roller, an inner eccentric bushing and an outer eccentric bushing surrounding the inner eccentric bushing, such that the inking roller is provided with a double eccentric support.

3. The anilox offset printing unit according to claim 2, wherein the adjusting means further comprises an adjusting device for the inner eccentric bushing and an adjusting device for the outer eccentric bushing.

4. The anilox offset printing unit according to claim 3, wherein the adjusting device for the inner eccentric bushing comprises a stop member, and a motor for adjusting the stop member, and an adjusting cylinder connected to the inner eccentric bushing, and wherein the adjusting device for the outer eccentric bushing comprises a pull element connected to the outer eccentric bushing, and a motor for adjusting the pull element.

5. The anilox offset printing unit according to claim 3, wherein the means for controlling the adjusting means comprises a switching arrangement connecting the measuring means to the adjusting device for the inner eccentric bushing and to the adjusting device for the outer eccentric bushing.

6. The anilox offset printing unit according to claim 5, wherein the switching arrangement comprises setting means for providing desired values for comparison, a comparator element connected to the setting means for comparing the desired values from the setting means with parameter values from the measuring means, a transmission element connected to the comparator element, and a signal amplifier connected to the transmission element.

7. The anilox offset printing unit according to claim 5, wherein the measuring means is a thermo-sensitive measuring element.

8. The anilox offset printing unit according to claim 7, wherein the measuring means is mounted one of in and on one of the side walls.

9. The anilox offset printing unit according to claim 5, wherein the measuring means comprises a plurality of thermo-sensitive elements for measuring the temperature of the screen roller, for measuring the temperature of the inking roller, for measuring the temperature of the plate cylinder, and for measuring the temperatures of the side walls.

10. The anilox offset printing unit according to claim 9, wherein the thermo-sensitive elements for measuring the temperature are integrated in at least one of the screen roller, the inking roller, and the plate cylinder, and wherein the thermo-sensitive elements for measuring the temperatures of the side walls are mounted within the side walls.

11. The anilox offset printing unit according to claim 2, wherein the double eccentric support of the inking roller comprises means for axially inclining the inking roller relative to the screen roller and the plate cylinder.

* * * * *